US006835470B1

(12) United States Patent
Magain et al.

(10) Patent No.: US 6,835,470 B1
(45) Date of Patent: Dec. 28, 2004

(54) ELECTROLUMINESCENT DEVICE AND METHOD FOR THE PRODUCTION THEREOF

(75) Inventors: Pascal Magain, Montbliart (BE); René Winand, Rixensart (BE)

(73) Assignee: Recherche et Developpement du Groupe Cockerill Sambre en abrégé: RD-CS, Liège (BE)

( * ) Notice: Subject to any disclaimer, the term of this patent is extended or adjusted under 35 U.S.C. 154(b) by 99 days.

(21) Appl. No.: 10/048,017

(22) PCT Filed: Jul. 28, 2000

(86) PCT No.: PCT/BE00/00090

§ 371 (c)(1),
(2), (4) Date: Jan. 28, 2002

(87) PCT Pub. No.: WO01/10173

PCT Pub. Date: Feb. 8, 2001

(30) Foreign Application Priority Data

Jul. 28, 1999 (BE) ..... 9900516

(51) Int. Cl.[7] ..... H05B 33/26; H05B 33/04; H05B 33/12

(52) U.S. Cl. ..... 428/690; 428/917; 313/502; 313/506; 313/509; 313/512; 427/66

(58) Field of Search ..... 428/690, 917; 313/502, 506, 509, 512; 427/66

(56) References Cited

U.S. PATENT DOCUMENTS 3,626,240 A 12/1971 MacIntyre
4,416,933 A * 11/1983 Antson et al. ..... 428/216
4,509,066 A * 4/1985 Schachter et al. ..... 357/2
5,652,067 A * 7/1997 Ito et al. ..... 428/690
5,674,635 A * 10/1997 Hsieh et al. ..... 428/690
5,776,622 A * 7/1998 Hung et al. ..... 428/690
5,856,029 A * 1/1999 Burrows ..... 428/690
5,856,031 A * 1/1999 Burrows ..... 428/690
6,307,528 B1 * 10/2001 Yap ..... 345/45

FOREIGN PATENT DOCUMENTS

| | | |
|---|---|---|
| EP | 0 881 863 A2 | 12/1998 |
| EP | 0 869 701 B1 | 6/2003 |
| HU | 183 831 | 10/1983 |
| WO | WO 97/46053 | 12/1997 |

OTHER PUBLICATIONS

Arno Kraft et al; "Electroluminescent Conjugated Polymers—Seeing Polymers in a New Light"; *Angew: Chem. Int.Ed.* 1998; 37, 402–428.

R. H. Friend et al; "Electroluminescence in Conjugated Polymers"; *Nature*, vol. 397; 1999; pp. 121–128.

* cited by examiner

*Primary Examiner*—Dawn Garrett
(74) *Attorney, Agent, or Firm*—Browdy and Neimark, P.L.L.C.

(57) ABSTRACT

An electroluminescent device comprising two electrodes (3, 5) whereby at least one organic electroluminescent semiconducting layer (4) is arranged therebetween, in addition to a substrate (2) supporting said device, and an electric current source (1) which is electroconductively linked to said electrodes. The inventive device is characterized in that substrate (2) is made or a metal or metal alloy.

40 Claims, 2 Drawing Sheets

ELECTROLUMINESCENT DEVICE AND METHOD FOR THE PRODUCTION THEREOF

Figure 1:
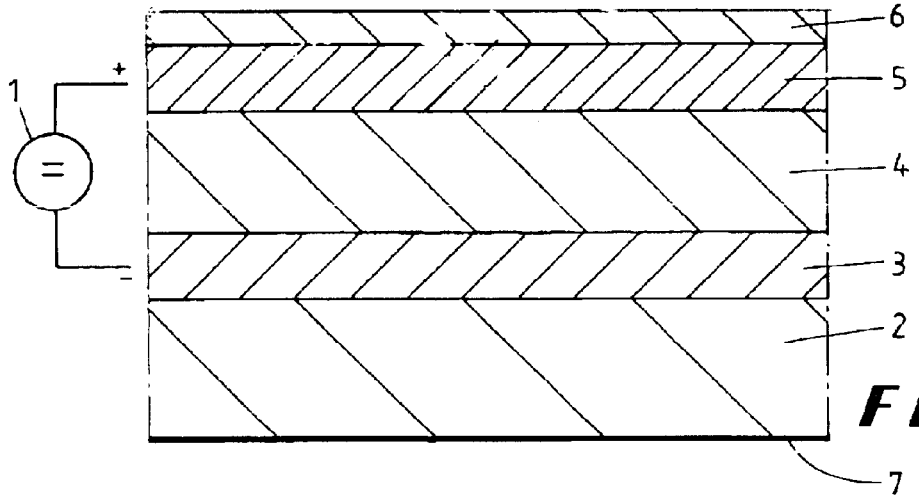

The present invention relates to an electroluminescent device comprising two electrodes, between which there is arranged at least one electroluminescent organic semiconductor layer, and a substrate supporting the said device, as well as an electric current source connected to the electrodes in an electrically conductive manner. The invention also concerns a method of manufacturing such a device.

Within the meaning of the invention, the expression "at least one electroluminescent organic semiconductor layer" means an electrically conductive, possibly multilayer, organic material in which an electroluminescence phenomenon may arise when on the one hand electrons and on the other hand positive holes are injected therein. The recombination of these charges with opposite signs causes the emission of light. This is therefore, in the sense of the invention, an electroluminescence said to be by injection.

The phenomenon of electroluminescence using organic semiconductors was revealed for the first time in the 1960s and the development of these electroluminescent systems based on organic thin films dates from the second half of the 1980s. In this regard reference can be made to the following publications: A. L. Kraft, A. C. Grimsdale, A. B. Holmes, Electroluminescent conjugated polymers—Seeing polymers in a new light, Angew. Chem. Int. Ed. (1998) 37, 402–428, and R. H. Friend, R. W. Gymer, A. B. Holmes, J. H. Burroughes, R. N. Marks, C. Taliani, D. D. C. Bradley, D. A. Dos Santos, J. L. Bredas, M. Lögdlund, W. R. Salaneck, Electroluminescence in conjugated polymers, Nature/1999/397, 121–128.

In the majority of the cases of the systems used, it is the glass which is taken as a substrate. Successive thin layers constituting the electroluminescent system are deposited on this. More recently, PET (polyethylene terephthalate) has been envisaged for replacing glass. Glass and PET being transparent, indium-tin oxide (ITO) is deposited directly on this substrate, constituting the positive electrode intended, in DC current, to inject positive holes into the organic semiconductor, which is in its turn deposited in one or more layers, possibly consisting of different molecules, on the layer of ITO. Finally, a thin layer of aluminium, magnesium or calcium is deposited on the whole, constituting in DC current the negative electrode intended to inject electrons into the organic semiconductor. It is the hole-electron recombination which generates the light emitted by the system through the glass or PET substrate. In the systems which use alternating current (SCALE: Symmetrically Configured Alternating current Light Emitting devices), the same electrodes are found (ITO on glass or on PET and aluminium, copper or gold) but electrodes no longer necessarily need to have a working function different from each other.

These devices have the drawback that the substrate is a thermally insulating material. During use at high power density this substrate does not allow an appropriate release of heat, which can result in disturbance in the device. In addition, in the case of glass, the substrate is fragile whilst in the case of PET it is flexible. Neither of these two substrates therefore resists the static and dynamic mechanical stresses borne during the use of electroluminescent devices.

Systems are also known which make use of "phosphoruses" as a source of electroluminescence. These phosphoruses are inorganic compounds which are separated from a conductive rigid substrate by a dielectric layer, possibly with variable resistance. The phosphoruses are generally encapsulated, for example in a polymerisable resin. They are placed in an alternating electric field which moves the electrons created within them by thermal agitation and the corresponding positive holes created in the valency band. These electrons produce excitations by collision, with the subsequent production of light. This is therefore in this case what is called intrinsic electroluminescence (see for example WO-97/46053 and U.S. Pat. No. 3,626,240).

To excite the "phosphoruses" it is necessary to create an alternating field of sufficient intensity, and hence the necessity for the presence of a dielectric and/or resistive layer. The result is high electrical voltages of 60 to 500 V in oscillating alternating current at 50 Hz–2.5 kHz and high thicknesses of approximately 100 $\mu$m.

The purpose of the present invention is to develop an electroluminescent device with an organic semiconductor which makes it possible to avoid these problems in a simple fashion.

An electroluminescent device as described at the start has been provided according to the invention, in which the substrate consists of a metal or metallic alloy. Such a substrate has sufficient thermal conductivity to allow discharge of the heat released by the electroluminescent system, especially when the latter is used at high power density.

Advantageously the metallic alloy is a steel, for example soft steel or stainless steel. Steel offers the property of being both rigid and easy to shape, which is advantageous for many applications of electroluminescent devices, such as illuminating panels and external or internal luminaires, decorative systems and fixed or programmable display systems.

According to one advantageous embodiment of the invention, a first electrode is disposed on a first side of the said at least one layer of electroluminescent organic semiconductor, on a first surface thereof which faces the substrate, and a second electrode is disposed on a second side of the said at least one layer of electroluminescent organic semiconductor, on a second surface thereof which is opposite the substrate, this second electrode allowing an at least partial passage of light.

As already mentioned, the device can comprise one or more successive layers of electroluminescent organic semiconductor. First surface and second surface mean, in the case of a single layer of semiconductor, the two faces thereof. In the case of several successive layers, they are the two external faces of this set of layers.

Using a substrate made of metal, metallic alloy or steel advantageously has the effect of allowing a reversal in the arrangement of the layers in the electroluminescent system compared with that of the systems according to the state of the art. This is because the light emitted by the device no longer passes through the substrate but only through one of the electrodes, the one opposite to the substrate, and through any external encapsulation thereof in transparent material, preferably impervious to water and air.

Advantageously, to manufacture this electrode situated opposite the substrate the most transparent possible material is used. It is possible to envisage for example inorganic electrode materials as used in the known electroluminescent or photovoltaic devices for electrodes supported directly by a glass or PET substrate. It is possible to cite, as non-exhaustive examples, indium-tin oxide (ITO), indium-zinc oxide (IZO) or systems based on indium-(zinc, gallium) oxides or ZnO, SnO2, ZnS, CdS, ZnSe, ZnxCd1-xO, ZnTe.

It is also possible to use organic transparent electrically conductive materials, such as for example p-doped conjugated polymers, polypyrrole, polythiophene, polyaniline, polyacetylene (CHx) as well as derivatives of mixtures of these substances. It is also possible to make use of several of these superimposed conductive layers, for example a layer of ITO coated with a conjugated polymer.

As a transparent encapsulation material, it is possible to provide by way of example a thin layer of silica deposited for example by the so-called PECVD (Physical Enhanced Chemical Vapour Deposition) technique (SiOx).

According to one advantageous embodiment of the invention, the substrate is connected to the current source. The steel is a good electronic conductor and it can therefore serve as a current feed for one of the electrodes with which it is contact. The substrate can itself serve as an electrode.

It is obviously possible also to provide a device according to the invention in which the substrate supports an electrode which is directly connected to the current source without the current passing through the substrate.

As an electrode material situated on the substrate side, it is possible to envisage any appropriate material for this purpose. Notably the materials indicated above for the electrode situated opposite the substrate can be envisaged. It is however also possible to envisage, as an electrode, the substrate in the form not only of steel sheet itself but more particularly in the form of this sheet which has undergone a surface treatment.

For surface treatment, it is possible to envisage according to the invention any treatment for obtaining superficially in the sheet or on the surface of the sheet a compound which is a good conductor of electricity. It is for example possible to first treat the steel sheet by means of a controlled oxidation so that, at least on the surface, it has a greater proportion of a good conductor, for example Fe3 O4. This controlled oxidation can be designed in a known manner, for example by electrolysis or oxidation in air.

It is also possible to provide, as a surface treatment, the application to the steel sheet of a conductive coating, notably zinc, zinc slightly or greatly alloyed with aluminium, aluminium, chromium or tin. Such coatings can for example be obtained, according to circumstances, by electrolytic deposition or by hot quenching deposition, according to techniques known to experts.

It is also possible to envisage, as surface treatment, the application to the substrate of a thin layer of a metal or alloy other than the one forming the substrate, for example aluminium, magnesium or calcium on a steel sheet. This application can be effected by any means known to experts, for example by vacuum evaporation or cathodic sputtering.

It is possible to envisage the application to the bare substrate, or to the substrate already with surface treatment, of at least one conductive polymer. It is possible to cite, as examples of conductive polymer, polyacetylene, polyaniline, polypyrrole, polythiophene, derivatives thereof and mixtures thereof.

According to one advantageous embodiment of the invention, the substrate is made from steel treated so as to reflect a light emitted from the organic electroluminescent semiconductor layer. The non-transparent steel serving as a substrate can for this purpose be for example polished, as well as its non-transparent coating. It is also possible for the electrode provided on the substrate side and any surface coating of the substrate also to be transparent. Such an arrangement makes it possible to increase not insignificantly the light emission efficiency of the system.

As an electrode material, it is possible to use in particular in this case a material as indicated above with regard to the materials to be used for the electrode situated opposite the substrate.

The replacement of the glass or PET, transparent products, as a substrate by steel, a non-transparent product, makes it possible to use both faces to create electroluminescent devices which are identical or possibly different from one face to the other (changing colour or display).

Other details and particularities of the device according to the invention are indicated in claims 1 to 17. The present invention also concerns a method of manufacturing an electroluminescent device, comprising an arrangement of at least one layer of electroluminescent organic semiconductor between two electrodes, a support for the device by means of a substrate, and a connection of the electrodes to an electric current source. According to the invention, this method comprises an arrangement of a first electrode on a substrate consisting of a metal or metallic alloy, a deposition of said at least one layer of electroluminescent organic semiconductor on the first electrode, and a deposition of a second electrode allowing an at least partial passage of the light on the said at least one layer of organic semiconductor and, possibly a deposition of a transparent material impervious to air and water on the second electrode, so as to encapsulate the device.

Other details and particularities of the method according to the invention are indicated in claims 18 to 24.

Other details and particularities of the invention will emerge from the description given below, non-limitatively and with reference to the accompanying drawings, of a few example embodiments of the device according to the invention.

FIGS. 1 to 4 are schematic representations in section of devices according to the invention. It should be noted that the given dimensions are not to scale. The relative dimensions between layers are also not complied with.

FIG. 1 depicts an electroluminescent device supplied by a DC current source 1. The substrate 2 is formed by a steel sheet, for example made from soft steel, which supports a thin layer 3 of a zinc and aluminium alloy, serving as a negative electrode. This layer can for example be deposited on the steel by a hot-bath immersion method. A layer of appropriate electroluminescent organic semiconductor 4 is applied to the negative electrode 3 for example in the form of a solution from which the solvent is then evaporated at atmospheric pressure or under partial vacuum, or by evaporation-condensation under vacuum of oligomers with a fairly low molecular mass. On the side opposite to the substrate 2, a positive electrode 5, which is transparent, based for example on ITO, is deposited advantageously under vacuum on the layer of organic semiconductor 4, for example according to the technique of reactive cathodic sputtering. Finally, there is provided, in order to protect the whole, a transparent encapsulation layer 6, for example made from silica, applied notably by a method of the PECVD (Physical Enhanced Chemical Vapour Deposition) type, and on the external face of the steel sheet 2 an insulation, for example in the form of a layer of electrically insulating paint 7.

The at least one layer of electroluminescent organic semiconductor according to the invention is a thin layer which can have a maximum thickness of a few micrometers.

In the case illustrated in this FIG. 1, the current source 1 is directly connected to each of the electrodes 3 and 5. It is of course possible to provide a connection of the current source 1 to the steel sheet 2, which would then serve as a current feed to the electrode 3.

Figure 2:
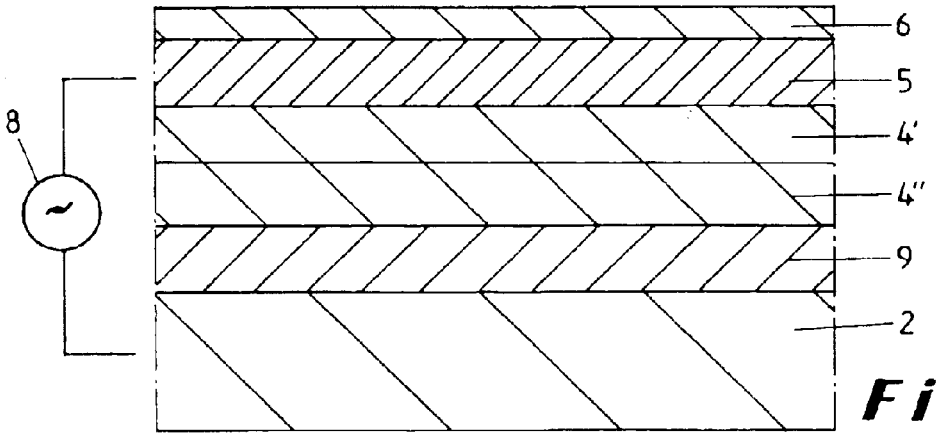

In FIG. 2, a device has been provided similar to the one illustrated in FIG. 1, but to be used with a power supply from an AC current source 8. This is connected on the one hand to the electrode layer based on ITO 5 and on the other hand to the steel sheet 2 forming the substrate and serving simultaneously as an electrode opposite the electrode 5. The two electrodes serve alternately as a positive electrode and negative electrode.

To improve the distribution and the passage of electricity, the sheet is coated on the surface with a layer of organic conductor 9, for example CHx (polyacetylene), which can be deposited on the sheet by vacuum reactive cathodic sputtering. This layer is advantageously transparent and the surface of the sheet coated with this layer 9 has been treated previously in order to reflect the light emitted by the electroluminescent system, which improves the efficiency thereof.

In the example embodiment illustrated in FIG. 2, two layers 4', 4" of electroluminescent organic semiconductors have been shown, these being able to be identical in the successive layers, or different.

It is also possible to provide between the layers 4', 4" and the ITO-based electrode a layer of polyacetylene, not shown, similar to the layer 9, in order to improve here also the distribution and passage of electricity.

Figure 3:
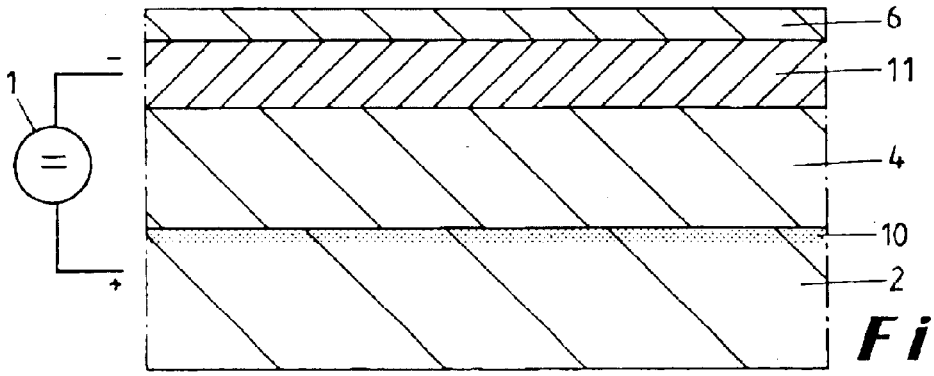

The example embodiment illustrated in FIG. 3 is identical to the one in FIG. 1, except that the substrate 2 serves here as a positive electrode. For this purpose, it has advantageously been oxidised in a controlled manner in order to show a layer 10 with a higher content for example of Fe3 O4. The opposite electrode 11 in this case advantageously consists of a transparent conductive polymer.

Figure 4:
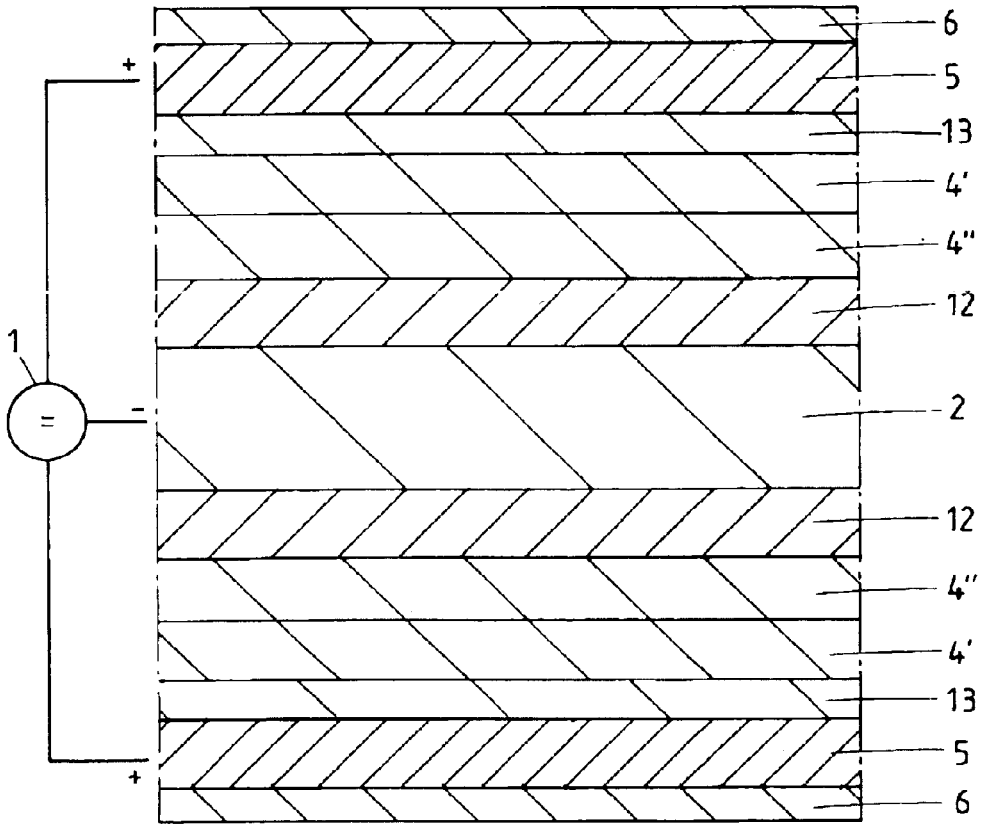

In the example embodiment according to FIG. 4, the soft steel sheet serves as a substrate 2 for two electroluminescent devices identical on each of its faces.

The faces of the substrate have been activated on the surface by vacuum plasma, and then a layer of aluminium 12 has been deposited on each of them, for example by evaporation or vacuum cathodic sputtering.

Between the successive layers 4', 4" of electroluminescent organic semiconductor and the electrode formed by the layer of ITO 5, a layer of polyacetylene 13 has been provided to improve the distribution and the passage of the electric current.

An arrangement as provided in this figure is impossible to envisage with the electroluminescent devices according to the known state of the art since, in the latter, the light must be able to pass through the substrate.

It must be understood that the present invention is in no way limited to the embodiments described above and that many modifications can be made to them without departing from the scope of the claims.

It would for example be possible to introduce, between the substrate and the at least one layer of electroluminescent organic semiconductor, a very thin layer of an electrical insulator nevertheless allowing the passage of electrons by tunnel effect, with a view for example to homogenising the transfer of electrons.

It would also be possible to envisage introducing, into the at least one layer of electroluminescent organic semiconductor, electrophosphorescent molecules for improving the quantum yield.

What is claimed is:

1. Electroluminescent device comprising:

a first electrode and a second electrode allowing an at least partial passage of light, at least one layer of organic semiconductor showing an electroluminescence by charge injection, a supporting substrate consisting of a metal or metallic alloy, and an electric current source connected to the electrodes in an electrically conductive manner, said substrate having two opposite surfaces comprising an electrically conductive surface which supports said device and a surface which is electrically insulated from the outside, the substrate supporting on said electrically conductive surface as successive layers:

the first electrode, which is continuously or alternatively a negative electrode, said at least one layer of organic semiconductor showing an electroluminescence by charge injection, and said second electrode allowing an at least partial passage of light, which is continuously or alternately a positive electrode.

2. Device according to claim 1, wherein the metallic alloy is a steel.

3. Device according to claim 1, wherein the substrate is connected to the current source.

4. Device according to claim 3, wherein the substrate forms one of the said two electrodes.

5. Device according to claim 3, wherein the substrate is in electrically conductive contact with one of the said two electrodes and forms a current feed for it.

6. Device according to claim 1, wherein the substrate supports one of the said two electrodes, which is connected to the current source.

7. Device according to claim 1, wherein the substrate is formed by a steel sheet which has undergone a surface treatment.

8. Device according to claim 7, wherein the substrate which has undergone a surface treatment has superficially in the steel sheet a compound which is a conductor of electricity.

9. Device according to claim 7, wherein the steel sheet has a surface coating which is a conductor of electricity.

10. Device according to claim 9, wherein the surface coating comprises at least one layer of a material selected from the group consisting of zinc, zinc alloyed with aluminium, aluminium, magnesium, calcium, tin and chromium.

11. Device according to claim 9, wherein the surface coating consists of at least one layer of at least one conductive polymer.

12. Device according to claim 11, wherein the said at least one conductive polymer is selected from the group consisting of polyacetylene, polyaniline, polypyrrole, polythiophene, derivatives thereof and mixtures thereof.

13. Device according to claim 7, wherein the substrate is made from steel treated so as to reflect a light emitted from the said at least one layer of organic electroluminescent semiconductor.

14. Device according to claim 1, wherein the second electrode has, opposite the substrate, an encapsulation made from a transparent material impervious to air and water.

15. Method of manufacturing an electroluminescent device according to claim 1, comprising:

an arrangement of the first electrode, which is continuously or alternatively a negative electrode, on a first surface of the supporting substrate consisting of a metal or metallic alloy, a deposition of the at least one layer of organic semiconductor showing an electroluminescence by charge injection on the first electrode, a deposition of the second electrode allowing at least partial passage of light on the at least one layer of organic semiconductor, and which is continuously or alternatively a positive electrode, and an electrical insulation of a second surface of said substrate.

16. Method according to claim 15, wherein the substrate consists of a steel sheet.

17. Method according to claim 16, wherein said arrangement of a first electrode comprises an activation of the steel sheet to make it able to fulfill a role of first electrode, the method comprises an electrical connection between the electrical current source and the steel sheet.

18. Method according to claim 15, wherein said arrangement of the first electrode comprises an application of the first electrode to said first surface of the substrate.

19. Method according to claim 15, comprising as a first operation, a surface treatment of the substrate.

20. Method according to claim 19, comprising, by way of surface treatment, a surface coating of the substrate by at least one electrically conductive compound.

21. Method according to claim 19, comprising, by way of surface treatment, an enrichment of the substrate, at least on the surface, with an electrically conductive compound.

22. Method according to claim 15, further comprising a deposition of a transparent material impervious to air and water on the second electrode, so as to encapsulate the device.

23. Device according to claim 1, wherein said at least one layer of organic semiconductor showing an electroluminescence by charge injection contains electrophosphorescent molecules.

24. Device according to claim 1, wherein the electric current source supplies the device with continuous current.

25. Device according to claim 1, wherein the electric current source supplies the device with alternating current.

26. Electroluminescent device comprising two electrodes between which there is arranged at least one layer of electroluminescent organic semiconductor, and a substrate supporting the said device, as well as an electric current source connected to the electrodes in an electrically conductive manner, characterized in that the substrate consists of a metal or metallic alloy, wherein the substrate has a first surface on which it supports the said device and a second surface, opposite to said first surface, on which it supports an additional said electroluminescent device.

27. Electroluminescent device according to claim 26, wherein the substrate forms one of the electrodes for each said at least one layer of electroluminescent organic semiconductor.

28. Device according to claim 26, wherein a first electrode is disposed on a first side of the said at least one layer of electroluminescent organic semiconductor, on a first face thereof which faces the substrate, and in that a second electrode is disposed on a second side of said at least one layer of electroluminescent organic semiconductor, on a second face thereof which is opposite the substrate, this second electrode allowing an at least partial passage of light.

29. Device according to claim 28, wherein the second electrode has, opposite the substrate, an encapsulation made from a transparent material impervious to air and water.

30. Device according to claim 26, wherein the metallic alloy is steel.

31. Device according to claim 26, wherein the substrate is connected to the current source.

32. Device according to claim 31, wherein the substrate is in electrically conductive contact with one of said two electrodes and provides a current feed thereto.

33. Device according to claim 31, wherein the substrate forms one of said two electrodes.

34. Device according to claim 26, wherein the substrate supports one of the said two electrodes, which is connected to the current source.

35. Device according to claim 26, wherein the substrate is formed by a surface treated steel sheet.

36. Device according to claim 35, wherein the steel sheet has a surface coating which is a conductor of electricity.

37. Device according to claim 36, wherein said surface coating comprises at least one layer of a material selected from the group consisting of zinc, zinc alloyed with aluminium, aluminium, magnesium, calcium, tin and chromium.

38. Device according to claim 36, wherein the surface coating consists of at least one layer of at least one conductive polymer.

39. Device according to claim 38, wherein said at least one conductive polymer is selected from the group consisting of polyacetylene, polyaniline, polypyrrole, polythiophene, derivatives thereof and mixtures thereof.

40. Device according to claim 35, wherein the substrate is made from steel treated so as to reflect light emitted from said at least one layer of organic electroluminescent semiconductor.

* * * * *